US006767851B1

(12) United States Patent
Rökman et al.

(10) Patent No.: US 6,767,851 B1
(45) Date of Patent: Jul. 27, 2004

(54) CHOPPED STRAND NON-WOVEN MAT PRODUCTION

(75) Inventors: Kay Rökman, Karhula (FI); Juhani Jansson, Karhula (FI); Harri Kostamo, Tavastila (FI); Juha Bohm, Kotka (FI)

(73) Assignee: Ahlstrom Glassfibre Oy, Karhula (FI)

( * ) Notice: Subject to any disclaimer, the term of this patent is extended or adjusted under 35 U.S.C. 154(b) by 0 days.

(21) Appl. No.: 09/543,534

(22) Filed: Apr. 5, 2000

(51) Int. Cl.[7] ..... D04H 5/00; D21F 11/00; D21H 11/00; D21H 17/00; D21H 21/00

(52) U.S. Cl. ..... 442/327; 442/340; 442/344; 162/100; 162/141; 162/149; 162/156; 162/157.1; 162/157.5

(58) Field of Search ..... 442/327, 340, 442/344; 162/100, 141, 149, 156, 157.1–157.5

(56) References Cited

U.S. PATENT DOCUMENTS

| | | | | | |
|---|---|---|---|---|---|
| 3,684,645 | A | | 8/1972 | Temple et al | |
| 4,112,174 | A | * | 9/1978 | Hannes et al. | 428/220 |
| 4,118,272 | A | | 10/1978 | Ziegler et al. | |
| 4,129,674 | A | | 12/1978 | Hannes et al. | |
| 4,200,487 | A | | 4/1980 | Bandoc et al. | |
| 4,242,404 | A | | 12/1980 | Bondoc et al. | |
| 4,284,470 | A | | 8/1981 | Bondoc | |
| 4,445,974 | A | | 5/1984 | Stenberg | |
| 4,886,701 | A | | 12/1989 | Ehnert et al. | |
| 5,409,573 | A | * | 4/1995 | Weeks | 162/145 |
| 5,698,476 | A | * | 12/1997 | Johnson et al. | 442/175 |
| 5,872,067 | A | | 2/1999 | Meng et al. | |
| 5,883,023 | A | | 3/1999 | Martine et al. | |
| 5,904,809 | A | | 5/1999 | Rökman et al. | |
| 6,019,871 | A | | 2/2000 | Rokman et al. | |
| 6,054,022 | A | * | 4/2000 | Helwig et al. | 162/156 |
| 6,163,943 | A | * | 12/2000 | Johansson et al. | 162/115 |
| 6,238,518 | B1 | | 5/2001 | Rokman et al. | |
| 2001/0004926 | A1 | | 6/2001 | Rockman et al | |

OTHER PUBLICATIONS

Glass Science and Technology 6, *The Manufacturing Technology of Continuous Glass Fibres*, Third, completely revised edition, K. L. Loewenstein, Elsevier, Amsterdam–London–New York–Tokyo, 1993, pp. 14–15, 98–99, 120–121, 136–137, 178–179, 196–199, 293–312.

* cited by examiner

*Primary Examiner*—Terrel Morris
*Assistant Examiner*—Lynda Salvatore
(74) *Attorney, Agent, or Firm*—Nixon & Vanderhye P.C.

(57) ABSTRACT

A non-woven mat useful for a wide variety of purposes, including forming reinforced resin products, is produced in a manner having different specific uses of, and advantages over, conventional chopped strand mats and conventional glass tissue. The mat is preferably made by the foam process (but may be made by the liquid process), and at speeds well in excess of 60 m./min., and has a substantially uniform construction even when low density (e.g. 100 g/m$^2$ or less). At least 20% (preferably at least 85%) of the fibers are in fiber bundles with between 5–450 fibers/bundle. The fibers (typically at least 85%) have a length between 5–100 mm, preferably 7–50 mm, substantially the same as the length of the fiber bundle they are in. The fibers are preferably held in the bundles by substantially non-water soluble sizing, such as epoxy resin or PVOH. The fibers in the bundles typically have diameters of approximately 7–500 microns, preferably about 7–35 microns. The bundles may comprise at least 10% reinforcing fibers, such as glass, aramid or acrylic.

10 Claims, 2 Drawing Sheets

CHOPPED STRAND NON-WOVEN MAT PRODUCTION

BACKGROUND AND SUMMARY OF THE INVENTION

In the manufacture of a wide variety of products, especially molded products, chopped fiber (e.g. glass fiber) mats are used in the molding operation and typically saturated with resin. These mats have conventionally been produced by air laid techniques, at a production rate that is normally between about 20–30 m/min., and must be relatively thick/dense otherwise they have too many holes and discontinuities to be fully effective in molding on other subsequent processing operations. These mats are typically made of fiber bundles having five or more fibers per bundle, typically about 10–450 fibers/bundle.

Glass tissue produced by the wet laid method or by the foam method comprises individual fibers or fiber bundles with very few (typically less than five) fibers in a bundle. Sometimes, some fiber bundles have not dispersed fully into the slurry. These poorly dispersed fiber bundles are elongated bundles, because the individual fibers of the bundle have slid with respect to each other. The length of an elongated fiber bundle is much longer than the length of the individual fibers. The fiber bundles that enter the slurry formation process comprise fibers that have the same length as the fiber bundle, since the yarn (typically about 10–450 fibers) is cut into bundles having a predetermined length in cutters. Elongated fiber bundles are defects in the fiber tissue, causing an uneven surface configuration of the tissue. In a poor quality glass tissue, there may be as much as about 5–10% elongated fiber bundles.

Exemplary prior art techniques for making glass fiber mats by the air laid method and making glass fiber tissue by the wet laid method are described in K. L. Loewenstein: The Manufacturing Technology of Continuous Glass Fibres, 1993 (incorporated by reference herein).

According to the present invention the limitations of the prior art mats described above are substantially overcome or minimized by employing one or more simple yet effective techniques. According to the present invention preferably the fibers are held in the bundles with a non-water soluble sizing, such as epoxy resin or PVOH, and/or 5–450 (e.g. about 10–450) fibers are provided in each bundle, each fiber having a diameter of about 7–500 microns, preferably about 7–35 microns, and at least about 85% of the fibers have a length of 5–100 mm, preferably about 7–50 mm (and all narrower ranges within these broad ranges).

According to the invention it is possible to produce mats having a substantially uniform density yet can be of much lower density than can be produced using air laid techniques. For example, mats can be produced having a density as low as 50 gm/in$^2$, or even less. The mats may be produced much more rapidly than by air laid techniques, and a wider variety is possible. For example, mats having multiple layers of different physical properties and/or compositions may readily be produced. These advantageous results are accomplished by using a water or foam laid process, so that production speeds of well over 60 m/min. (typically over 80 m/min, e.g. about 120 m/min.) are readily achieved, along with highly uniform mats of a wide variety of constructions. Utilization of the foam process is preferred, however, for many reasons, including process efficiency. Using the foam process the slurry can have 0.5–5% (or any smaller range within that broad range) fibers by weight, whereas in the wet laid process the maximum fiber content is about 0.05% by weight. If a larger percentage of fibers is used in the wet laid process then the viscosity of the liquid must be increased (by introducing additives), and that causes several problems, including the formation of air bubbles. This would require still further additives, making the wet laid process much more difficult and expensive compared to the foam process.

According to one aspect of the present invention there is provided a non-woven mat of chopped strands, comprising: A plurality of fibers disposed in a non-woven configuration to define a mat. At least 20% of the fibers in fiber bundles having between 5–450 fibers per bundle and the length of the bundles being substantially the same as the lengths of the fibers forming the bundles, and wherein at least 85% of the fibers of the fiber bundles have a diameter of between about 7–500 microns.

Preferably at least 85%, up to substantially 100%, of the fibers in the bundles have a length of between 5–100 mm, preferably 7–50 mm, most preferably between about 20–30 mm, and at least 50%, preferably at least 85% of substantially 100%, of the fibers in the bundles have a diameter of between 7–35 microns. Typically the fibers in the fiber bundle are held together with a substantially water insoluble sizing, such as epoxy resin or PVOH. Preferably substantially all of the fibers in a bundle are substantially straight.

The invention is particularly useful where at least 10% (preferably at least about 50%, up to substantially 100%) of the fibers in fiber bundles comprise reinforcement fibers selected from the group consisting essentially of glass, aramid, carbon, polypropylene, acrylic, and PET fibers, and combinations thereof. The invention is particularly suitable for use with glass fibers.

By practicing the invention it is possible to make mats with an extremely wide density range, e.g. between about 50–900 g/m$^2$, yet with substantially uniform density. For example, the mat may have a substantially uniform density of less than 75 g/m$^2$ (even below 50 g/m$^2$ depending the fibers utilized). When the mat has a density between about 50–150 g/m$^2$, 90% of the fibers in the fiber bundles have between 10–200 fibers per bundle. Typically at least 85% of the fibers in the fiber bundles have between 10–450 fibers per bundle and a length substantially the same as the length of the fiber bundle.

According to another aspect of the present invention a method of producing a non-woven chopped strand mat is provided comprising: (a) Forming a slurry of fibers in a liquid or foam (preferably foam) wherein at least 20% of the fibers in the slurry are in fiber bundles in which the fibers are held in the bundles by a substantially non-water soluble sizing. (b) Forming a non-woven web from the slurry on a foraminous element. And (c) withdrawing at least one of liquid and foam from the slurry on the foraminous element so as to form a non-woven mat. Preferably the slurry in (a) has between about 0.5–5% by weight fibers. The liquid process practice may be entirely conventional, and the foam process practice may be such as shown in U.S. Pat. No. 5,904,809, issued May 18, 1999 (the disclosure of which is hereby incorporated by reference herein). The invention also relates to products made from this method.

Because the invention uses a liquid or foam process as opposed to air laid process, the speeds of production are much greater. That is, (b) and (c) may be practiced at a speed of at least 60 m/min, typically at least 80 m/min, and may easily achieve speeds of 120 m/min. The foraminous may have any suitable conventional construction such as a conventional wire, or dual or multiple wires, etc. For example (a)–(c) may even be practiced using a moving web of fabric which becomes part of the mat produced as the foraminous element (or one of a plurality of such elements). Also by utilizing the invention (particularly such as by utilizing a segmented head box, such as shown in copending application Ser. No. 09/255,755, filed Feb. 23, 1999, the disclosure of which is incorporated by reference herein, or U.S. Pat. No. 4,445,974.

In the method typically (a) forming a slurry of fibers in a liquid or foam (preferably foam) wherein at least 20% of the fibers in the slurry are in fiber bundles in which the fibers are held in the bundles by a substantially non-water soluble sizing; (b) forming a non-woven web from the slurry on a foraminous element; and (c) withdrawing at least one of liquid and foam from the slurry on the foraminous element so as to form a non-woven mat. For example (a) is practiced using at least 10% (for example at least 50%, and at least 85%, up to substantially 100%) of reinforcing fibers in the fiber bundles, the reinforcing fibers selected from the group consisting essentially of glass, acrylic, aramid, carbon, polypropylene, and PET fibers, and combinations thereof. Also, (a)–(c) may be practiced so as to produce a mat having a substantially uniform density of between about 50–150 gm/m2.

The method may further comprise producing a second mat from at least a second slurry having a different fiber composition or density than the slurry from (a), and laying the at least a second slurry in a substantially non-mixing manner on the slurry from (a) to produce a composite mat having at least two substantially distant layers with different fiber compositions or densities. Alternatively or in addition the method may further comprise (d) providing at least one surface layer on the mat and affixing the at least one surface layer to the mat with a binder. The method typically further comprises curing the binder from (d) and drying the web in a drying oven. For example (a) is further practiced using heat activated binder powder or fibers in the slurry.

According to another aspect of the present invention there is provide a method of producing a non-woven chopped strand mat comprising: (a) Forming a slurry of fibers in a liquid or foam wherein at least 20% of the fibers in the slurry are in fiber bundles having between 10–450 fibers/bundle and a length substantially the same as the length of said fiber bundle, which length is between 5–100 mm for at least 85% of the fibers in bundles, and a diameter of the fibers in bundles of between 7–500 microns. (b) Forming a non-woven web from the slurry on a foraminous element. And (c) withdrawing at least one of liquid and foam from the slurry on the foraminous element so as to form a non-woven mat. The details of this aspect of the invention are preferably substantially as described above.

According to another aspect of the present invention there is provided a composite product comprising outer layers made from resin impregnated and cured mats as described above and an inner layer of at least one of inexpensive fibers, scrap fibers, and material of significantly lower density than said outer layers. A fiber based web may be manufactured from the foam process comprising at least two layers (or parts of layers) with different physical or chemical properties.

The invention also relates to a non-woven fibrous composite web manufactured by using a liquid or foam based process using a "multi-layer headbox" and/or "divided headbox", having at least two layers having substantially different properties, including at least one of different density, different material, different reinforcement threads, and different reinforcement webs. The composite web may comprise threads or webs of substantially continuous fibers and with directional properties, e.g. reinforcement threads and webs with directional strength properties that are fed to the web through the headbox. At least a part of the composite web may comprise a heat-activated binder in a powder form or in a fibrous form. At least 20% (e.g. at least 40%) of the fibers fed to a headbox may be attached to each other to form fiber bundles by using some appropriate hydrophobic sizing-agent such as epoxy resin or PVOH. Preferably the length of the fibers in a fiber bundle is substantially the same as the length of the fiber bundle, and the number of fibers in a fiber bundle is variable and preferably between about 10–450 fibers, and the length of the fibers in a fiber bundle is about 5–100 mm, preferably about 7–50 mm. At least on one side of the composite non-woven web there may be at least one surface layer of fabric that is attachable to the non-woven composite web by binders on the surface of the fabric or on the web in a drying oven (or the like) positioned after the web-formation apparatus (headboxes).

According to the present invention all narrower ranges within the broad ranges set forth above are specifically provided herein. For example, the diameter of the fibers in the bundles of between 7–500 microns comprises 9–450 microns, 10–30 microns, 9–300 microns, and all other narrower ranges within the broad range specified.

It is the primary object of the present invention to provide a highly advantageous mat, products made from the mat, and a method of production of the mat, that overcome a number of the problems in the prior art chopped glass fiber mat and glass tissue arts. This and other objects of the invention will become clear from a detailed description of the invention and from the appended claims.

DETAILED DESCRIPTION OF THE DRAWINGS

Figure 1:
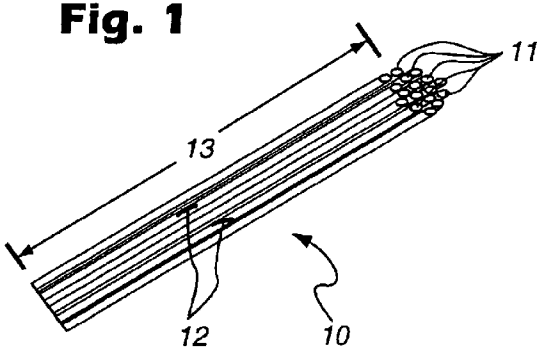
FIG. 1 is a schematic enlarged perspective view of an exemplary fiber bundle utilized according to the present invention.

FIG. 1 schematically illustrates at reference numeral 10 a fiber bundle according to the present invention. The fiber bundle 10 is made up of a plurality of individual fibers 11, typically between 5–450 fibers, more preferably between about 10–450 fibers, and any other narrower range within that broad range (such as set forth in Table I below). The fibers 11 in the bundle 10 are preferably held together with a substantially water insoluble sizing (shown schematically at 12 in FIG. 1), such as PVOH or epoxy resin, although a wide variety of other conventional sizings may be utilized.

Figure 2:
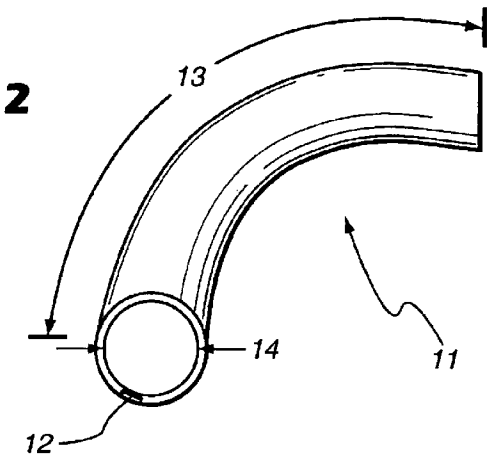
FIG. 2 is a schematic partially side and partially end view of an exemplary fiber utilized according to the present invention and coated with sizing.

As contrasted to the small numbers of fibers held in glass tissue bundles, for the fiber bundles 10 according to the present invention the length 13 of the fiber bundle 10 is substantially the same as the length of the individual fibers 11 forming the bundle 10. The length 13 of the individual fibers (also see the fiber 11 in FIG. 2 with sizing 12 coating), which again is substantially the same as the length of the fiber bundle, is typically between about 5–100 mm, preferably about 7–50 mm, most preferably about 20–30 mm. Typically at least 85% of the fibers in the bundles have a length of between 5–100 mm, preferably about 7–50 mm, most preferably about 20–30mm. Also, preferably the fibers 11 have a diameter 14 (see FIG. 2) which is between about 7–500 microns, preferably between 7–35 microns.

Note that substantially all of the fibers 11 in the bundle 10 are substantially straight, regardless of the material of which they are made (e.g. glass, aramid, carbon, etc.). The sizing 12 provides each fiber 11 with a protective coating, and causes the fibers (typically between 5–450 in number, e.g. about 100) 11 to adhere together in the bundle 10.

Figure 3:
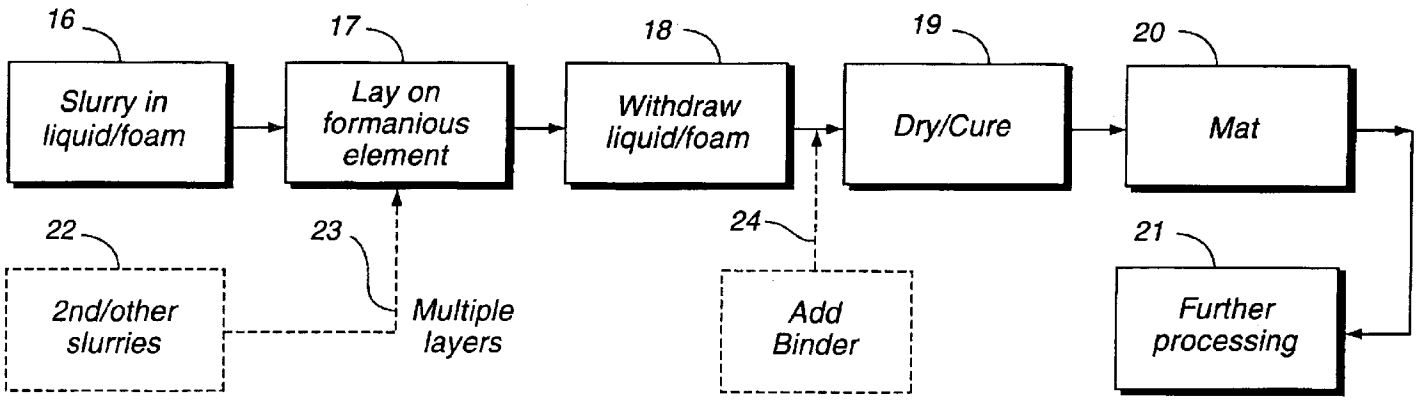
FIG. 3 is a box diagram of an exemplary method according to the invention.

FIG. 3 schematically illustrates an exemplary practice of a method according to the present invention. Box 16 schematically illustrates the formation of a slurry of fibers 11 in a liquid or foam wherein at least 20% (preferably at least 50%, more preferably at least 85% up to substantially 100%) of the fibers in the slurry are in fiber bundles 10 in which the fibers are held in the bundles by non-water soluble sizing 12. A binder may, under some circumstances (although it is not necessary under others) be added to the slurry at 16, or at some subsequent procedure during processing, which binder is subsequently cured to increase the integrity of the mat produced. Box 17 schematically illustrates forming a non-woven web from the slurry on a conventional foraminous element, which may be a single wire, dual wires, a fabric which becomes part of the mat produced, or any other suitable conventional foraminous element. The procedure practiced as illustrated by box 17 may be a conventional liquid process procedure utilizing a head box or the like conventional structure (e.g. see U.S. Pat. No. 4,445,974), or may be the foam process, such as shown in U.S. Pat. No. 5,904,809.

The method further proceeds to withdrawing liquid and/or foam from the web on the foraminous element, as illustrated schematically at 18 in FIG. 3, typically utilizing vacuum boxes or rolls, or the like. The liquid/foam withdrawal, and preferably the subsequent drying and/or curing in an oven as schematically illustrated at 19, results in mat 20 production (see the mats 26 schematically illustrated in FIGS. 4 and 5). The mat from 20 may be further processed as indicated at 21, which typically includes utilizing the mat as a reinforcing structure in a molding process wherein the mat is impregnated with resin to produce a functional article including, but not limited to, water sport boards, electrical component casings, industrial containers, automobile, boat, or other vehicle parts, etc.

As schematically illustrated at 22 in FIG. 3, other slurries having different fiber composition or physical properties (such as density) may also be formed and—as illustrated schematically at 23 in FIG. 3, multiple layers may be provided on the foraminous element, such as shown in copending application Ser. No. 09/255,755. Box 24 schematically illustrates an optional alternative or additional location for binder addition, as described above. Wherever the binder (if used) is added, it may be added in liquid, powder, or fiber form.

In the practice of the invention it is particularly desirable that at least 10% (preferably at least 50%, and often at least 85% up to substantially 100%) of the fibers 11 in the fiber bundles 10 comprise reinforcement fibers selected from the group consisting essentially of glass, aramid, carbon, polypropylene, acrylic, and PET fibers, and combinations thereof; for example about 50% of the fibers in the fiber bundles comprise glass fibers in the manufacture of many common articles. The density of the mat 26 (see FIGS. 4 and 5) produced may vary widely, between about 50–900 g/m$^2$. For example. Table 1 below indicates exemplary mat densities that may be produced according to the present invention and shows the minimum and maximum number of fibers 11 in the bundles 10 forming at least about 85% of the mat so produced. The split percentages given in Table 1 indicate the minimum and maximum percentage of fiber bundles 10 with the number of fibers in the bundles set forth for the corresponding density mat in Table 1.

TABLE I

| Weight | Fibers in bundles | | split | | split % | |
|---|---|---|---|---|---|---|
| g/m$^2$ | min | max | max | min | min | max |
| 50 | 10 | 200 | 20 | 5 | 60 | 95 |
| 100 | 10 | 200 | 20 | 5 | 60 | 95 |
| 125 | 15 | 200 | 20 | 5 | 60 | 95 |
| 150 | 15 | 200 | 20 | 5 | 60 | 95 |
| 200 | 20 | 200 | 15 | 5 | 60 | 95 |
| 225 | 20 | 200 | 15 | 5 | 60 | 95 |
| 250 | 30 | 250 | 15 | 5 | 60 | 95 |
| 300 | 30 | 250 | 15 | 5 | 60 | 98 |
| 450 | 50 | 300 | 15 | 5 | 60 | 98 |
| 600 | 50 | 400 | 12 | 5 | 60 | 98 |
| 900 | 50 | 450 | 10 | 5 | 60 | 98 |

Fiber diameters are between 7 and 35 micro meters

The values set forth in Table I are approximate.

The terms "split" and "split %" used in Table I are best described with respect to the normal production method of glass fiber bundles. The diameter of the fibers used is between 7–35 $\mu$m, e.g. about 11 $\mu$m.

The number of nozzles used to produce fibers (e.g. glass fibers) can vary from 1600–4000, usually divided into at least two bushings. If there are 1600 nozzles divided into two bushings, 800+800 fibers are drawn downwardly from the nozzles. First they are treated by applicators with a spray of sizing agent; according to the invention the sizing agent is substantially water insoluble.

The term "split 8" then means that the first 800 fibers and the second 800 fibers are both gathered by a gathering shoe or comb so that they form 8+8 bundles, each containing 100 fibers. Each of the 8 bundles are then wound to make a fiber cake. The fibers in the bundles are not twisted, they just form a straight parallel bundle of continuous fibers.

The fiber cakes are drawn towards cutters, e.g. the bundles each having 100 fibers are then cut to certain length e.g. 20–30 mm and then fed to an endless chain link belt. According to the invention the 20–30 mm long fibers are fed from the cutters to a foam or liquid process so that a slurry of fibers in a liquid or foam is formed.

Substantially all of the fibers that are used according to the invention are treated by a water insoluble sizing agent so that when they are gathered together by a gathering shoe they stay together in a bundle. Sizing agent is used before the fibers are gathered together to provide sizing over substantially the entire fiber surface and to "glue" the fibers together when they are split or gathered together to form bundles.

The term "split" as used in Table 1 will be described with respect to a specific example: For a 50 g/m$^2$ weight mat, and 1600 nozzles, if one uses the maximum split, 20, that means that 800+800 fibers are split into 20+20 bundles of fibers, each bundle containing 40 fibers. If one uses the minimum split, 5, that will give 5+5 bundles and 160 fibers per bundle.

There is a minimum number of bundles that are needed to produce an even surface in a 50 g/m$^2$ mat. If there are too very few bundles, the surface of the mat is very rough; and there are only a few thick "logs" and the mat is very coarse. The more bundles there are, and thus the few fibers per bundle, the better and more even is the surface of the mat produced. According to the invention the formation of the mat produced by a foam process is superior compared to a mat of similar fibers having the same g/m$^2$ and the same split and produced by the conventional air laid process. This means that by using the foam process the bundles are very, very evenly distributed over the surface of the mat compared to the distribution produced by the air laid process.

The term "split %" as used in Table 1 describes how well these fibers stick together in the 20–30 mm long bundles that each contain, e.g. 100 fibers. This is very important in illustrating the difference between a chopped strand mat (regardless of the method by which it is produced; an air laid process, or the liquid or foam processes), and a tissue mat, especially a poor quality tissue mat.

In a tissue mat the fibers are, or should be, individual fibers. Sometimes they however tend to form bundles. When you have a poor quality tissue mat there can be as many as 10% of the fibers in bundles. Sometimes a "poor quality" tissue mat is produced intentionally to produce specific products e.g. base material for roof coverings. In this "poor quality" case some individual fibers have formed bundles, but these bundles are just a collection of individual fibers arranged in a random way. The length of this kind of bundle is substantially higher than the lengths of individual fibers.

There is a difference between a chopped strand mat produced by the foam method and a tissue mat produced by the foam method. In a chopped strand mat all the fibers should be in bundles and because of the technique used (formation of the bundles and the use of cutters) the length of the bundles in a chopped strand mat is substantially the same as the length of the fibers that form the bundle. Also at least 20% of the fibers that enter a headbox are in bundles and in practice about 60–98%, e.g. about 80%. The 100% ideal situation is not reality; two bundles can sometimes be glued together; also one bundle can split into individual fibers by mechanical collisions before it enters the wire or during the time it is exposed to water or water based foam, because of poor sizing on some fibers in a fiber bundle.

The "split %" describes how well one has succeeded in making the chopped strand bundles. The split % describes how many of the fibers that enter the chopped strand mat are in individual bundles. According to the invention the chopped strand bundles are collected after the cutters to be used in the foam based process. The "min" and "max" columns under "split %" in Table 1 indicate that between 60–98% (average 80%) of the fibers in a chopped strand mat (after the cutters) are in individual bundles, not loose as individual fibers or joined together as two bundle "logs".

Because the wet laid or foam processes are utilized in the practice of the invention, the speed of formation of the mats 26 may be greatly increased compared to air laid process which is used for conventional chop strand mats, and with little or no trapped air. According to the present invention the procedures set forth in boxes 17 through 19 of FIG. 3 may be practiced at at least 60 meters per minute, typically at least 80 meters per minute, and speeds of at least 120 meters per minute are easily achievable.

Also by practicing the invention it is possible to produce mats 26 have a substantially uniform density of less than 75 g/m$^2$, which is not practical utilizing conventional techniques. In conventional techniques where the mat has a density of about 100 g/m$^2$ or less the construction of the mat is non-uniform, there being holes or discontinuities which adversely affect the strength of the product (e.g. a molded industrial container or vehicle part) produced therefrom. However, according to the present invention mats 26 with substantially uniform density may be easily produced with a density of about 50–150 g/m$^2$, and possibly even lower densities, typically with at least 60% (e.g. about 60–95%) of the fiber bundle 10 having between 10–200 fibers 11 per bundle, each fiber 11 with a diameter between 7–35 microns.

Figure 4:
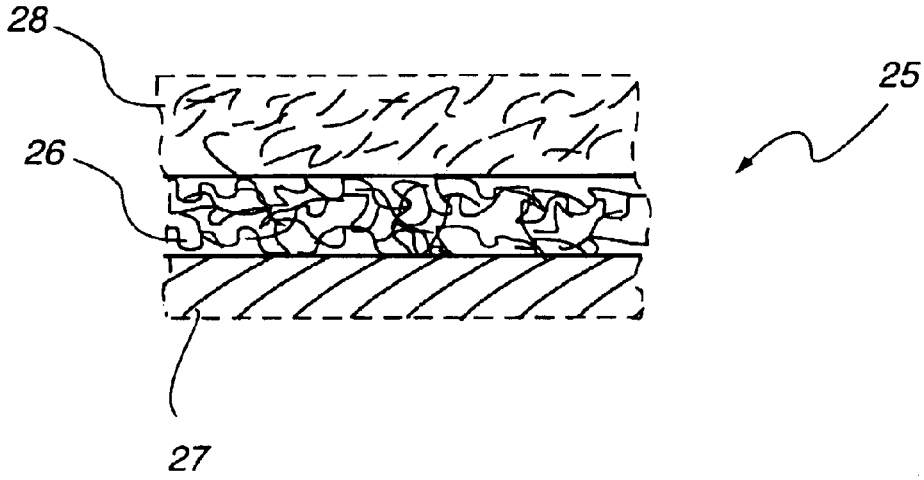
FIG. 4 is a side schematic view of an, exemplary mat according to the invention and showing various modifications thereof in dotted line.

FIG. 4 illustrates a composite mat construction 25 that may be produced according to the invention, in which the mat produced from the slurries illustrated in box 16 is formed on a fabric 27 as the foraminous element, the fabric 27 then becoming an integral part of the final product 25. FIG. 4 also schematically illustrates in dotted line a second mat 28 formed from another slurry 22 which has fiber and/or physical properties differing from that of the mat 26 (typically different by at least 5%, and preferably differing by at least 10% in both fiber composition/mixture and physical properties).

Figure 5:
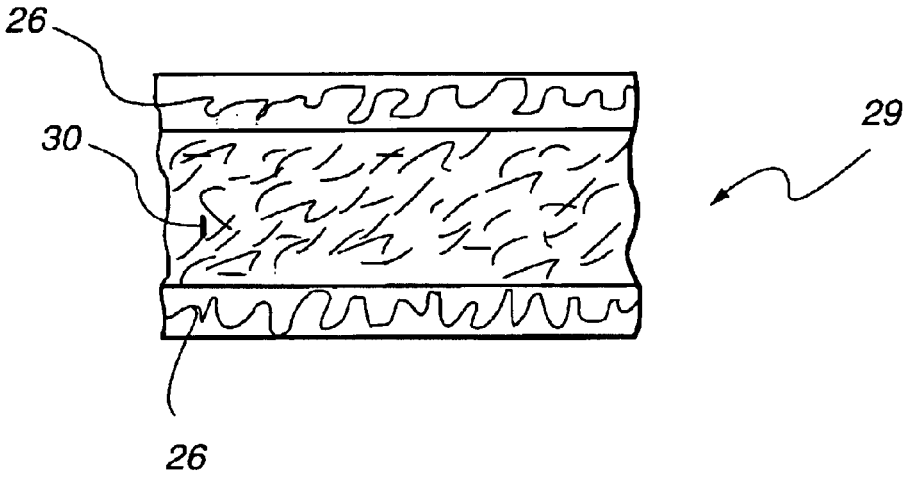
FIG. 5 is a side schematic cross-sectional view of an exemplary composite product according to the invention.

Utilizing the present invention it is possible to produce composite products which have high strength but much less expensively than in conventional constructions. FIG. 5 schematically illustrates one such composite product 29 which has mats 26 according to the present invention (which may have substantially the same, or different, fiber compositions and physical properties) which are processed in a further processing 21 schematically illustrated in FIG. 3 to form a sandwich with an inner layer 30 of at least one of inexpensive or scrap fibers, and material of significantly (e.g. at least 5%, preferably at least 20%) lower density than the outer mat layers 26. For example, the layer 30 may be scrap fiberglass and plastic fibers, or foam (with a density less than 20% that of the mats 26), or scrap fibers in a foam, etc.

In the practice of the invention the foam process is preferred, with about 0.5–5% by weight fibers 11 (in bundle 10 form) in the slurry 16 (see FIG. 3), without the need for any viscosity enhancing or bubble-formation reducing additives.

It will thus be seen that according to the present invention a highly advantageous method and products and composites are provided. The invention has numerous advantages over the related prior art, yet may be practiced in a simple and cost effective manner. While the most practical and preferred embodiment of the invention has been illustrated and described, it is to be understood that many modifications may be made thereof within the scope of the invention, which scope is to be accorded the broadest interpretation of the appended claims so as to encompass all equivalent methods, mats, and composites.

What is claimed is:

1. A non-woven mat of chopped strands, comprising:

a plurality of fibers disposed in a non-woven configuration to define a mat, wherein substantially 100% of said fibers are disposed in fiber bundles, wherein said fiber bundles have between 5–450 fibers per bundle and the length of said bundles being substantially the same as the lengths of the fibers forming said bundles, and wherein at least 85% of said fibers of said fiber bundles have a diameter of between about 7–500 microns; wherein said fibers in said fiber bundles are held together with a substantially water insoluble sizing, and wherein the integrity of the mat is increased by means of heat activated binder fibers.

2. A non-woven mat as recited in claim 1 wherein at least 85% of said fibers in said bundles have a length of between 5–100 mm.

3. A non-woven mat as recited in claim 2 wherein at least 85% of said fibers in said bundles have a diameter of between 7–35 microns.

4. A non-woven mat as recited in claim 3 wherein at least 10% of the fibers in said fiber bundles comprise reinforcement fibers selected from the group consisting essentially of glass, aramid, carbon, polypropylene, acrylic, and PET fibers, and combinations thereof.

5. A non-woven mat as recited in claim 1 wherein at least 50% of the fibers in said fiber bundles comprise glass fibers.

6. A non-woven mat as recited in claim 1 wherein at least 85% of said fibers in said bundles have a length of between 5–110 mm, and wherein at least 85% of said fibers in said bundles have a diameter of between 7–35 microns.

7. A non-woven mat as recited in claim 4 wherein at least 85% of said fibers in said fiber bundles are selected from said group.

8. A non-woven mat as recited in claim 1 wherein at least 85% of said fibers in said fiber bundles have a length of between about 7–50 mm.

9. A non-woven mat as recited in claim 1 wherein said mat has a density of between about 50–900 $g/m^2$.

10. A non-woven mat as recited in claim 1 wherein at least 85% of said fibers in said fiber bundles have between 10–450 fibers/bundle and a length substantially the same as the length of said fiber bundle, and a diameter between about 7–35 microns.

* * * * *